US005821414A

United States Patent [19]

Noy et al.

[11] Patent Number: 5,821,414

[45] Date of Patent: Oct. 13, 1998

[54] SURVEY APPARATUS AND METHODS FOR DIRECTIONAL WELLBORE WIRELINE SURVEYING

[76] Inventors: Koen Noy; Eric Wright; Gary Uttecht; James Brosnahan; Han Wei; Greg Neubauer, all of 1628 Westbelt N., Houston, Tex. 77043

[21] Appl. No.: 797,785

[22] Filed: Feb. 7, 1997

[51] Int. Cl.[6] ..... E21B 47/00; E21B 47/022

[52] U.S. Cl. ..... 73/152.54; 33/304

[58] Field of Search ..... 33/304, 313, 324; 73/152.54

[56] References Cited

U.S. PATENT DOCUMENTS

| | | | |
|---|---|---|---|
| 3,753,296 | 8/1973 | VanSteenwyk . | |
| 4,197,654 | 4/1980 | VanSteenwyk et al. . | |
| 4,199,869 | 4/1980 | VanSteenwyk . | |
| 4,238,889 | 12/1980 | Barriac . | |
| 4,265,028 | 5/1981 | VanSteenwyk . | |
| 4,293,046 | 10/1981 | VanSteenwyk . | |
| 4,297,790 | 11/1981 | VanSteenwyk et al. . | |
| 4,433,491 | 2/1984 | Ott et al. . | |
| 4,454,756 | 6/1984 | Sharp et al. | 73/152.54 |
| 4,459,760 | 7/1984 | Watson et al. . | |
| 4,542,647 | 9/1985 | Molnar | 73/152.54 |
| 4,812,977 | 3/1989 | Hulsing | 364/422 |
| 4,987,684 | 1/1991 | Andreas et al. . | |
| 5,657,547 | 8/1997 | Uttecht et al. | 33/304 |

*Primary Examiner*—Michael Brock
*Assistant Examiner*—Jay L. Politzer
*Attorney, Agent, or Firm*—Gunn & Associates, P.C.

[57] ABSTRACT

A wellbore survey method and apparatus which includes a gyroscope, wherein the gyroscope has a spin axis, aligned with the instrument axis, and further having two sensitive axis orthogonally related to the spin axis and to each other. In addition, the wellbore survey apparatus contains a drive means, functionally connected with the gyroscope, to rotate the gyro about the instrument axis. The wellbore survey apparatus also contains a set of accelerometers, wherein the sensitive axis are aligned orthogonally to each other, and said drive means is functionally connected to the accelerometers to rotate the accelerometers about the instrument axis. Sensors determine the azimuthal direction of inclination of the wellbore at a first location therein and while traversing from said first location. Attitude references of the wellbore with regard to said first location are determined while the tool is continuously traversing through the wellbore.

39 Claims, 5 Drawing Sheets

SURVEY APPARATUS AND METHODS FOR DIRECTIONAL WELLBORE WIRELINE SURVEYING

BACKGROUND OF THE DISCLOSURE

1. Field of the Invention

The present disclosure is directed to a wellbore survey method and apparatus, and more particularly to a survey system which enables mapping of the well borehole path while moving a survey instrument continuously along the well borehole by means of a wireline.

2. Background of the Art

Well borehole survey can be defined as the mapping of the path of a borehole with respect to a set of fixed, known coordinates A survey is required during the drilling of many oil and gas wells, and is of particular importance in the drilling of well which is deviated significantly from an axis perpendicular to the earth surface. Often two or three surveys will be required during the drilling process. In addition, a final survey is often required in a highly deviated well.

In drilling an oil well, it is rather easy to drill straight into the earth in a direction which is more or less vertical with respect to the surface of the earth. Indeed, regulatory agencies define a vertical well by tolerating a few degrees of deviation from the vertical. The interruption of the drilling operation and cost of the surveys is minimal in that situation. By contrast, highly deviated wells are required in a number of circumstances.

Onshore, it is necessary to drill a deviated well to enter formations at selected locations and angles. This may occur because of the faulting in the region. It is also necessary to do this around certain types of salt dome structures. As a further example of onshore, deviated drilling, a tremendous amount of interest has been developed in providing surveys of wells that have been deviated from a vertical portion toward the horizontal. Recently, a number of older wells drilled into the Austin chalk formation in the south central United States have played out and production has been lost. This has been a result of the loss of formation pressure. The Austin chalk producing strata is easily located and easily defined. It is however relatively thin. Enhanced production from the Austin chalk has been obtained by reentering old wells, milling a window in the casing, and reentry into the formation. The formation is typically reentered by directing the deviated well so that it is caught within the producing strata. In instances where the strata is perfectly horizontal with respect to the earth, that would require horizontal hole portion after curving into the strata. As a practical matter, the producing formations may also dip and so the last leg of the well may extend outwardly at some extreme angle such as 40° to 70°. Without being definitive as to the particular formation dip, such drilling is generally labeled horizontal drilling. The end result is that the borehole does not simply penetrate the formation, but is directed or guided follow the formation so that several hundred feet of perforations can then be placed to enable better production. To consider a single example, assume that the formation is 20' thick measured from the top to the bottom face. Assume as an example that the formation has a dip of 30°. By proper direction of the well during drilling, several hundred feet of hole can be drilled between the top and bottom faces of the formation. After drilling, but before casing has been completed, it is often necessary to conduct a concluding survey to assure that the production is obtained below the leasehold property. In addition, other surveys are required.

In offshore production, once a producing formation has been located, it is typically produced from a centrally positioned platform. Assume that the producing formation has an extent of four or five miles in lateral directions. Assume further that the formation is located at 5,000 feet or deeper. A single production platform is typically installed at a central location above the formation and supported on the ocean bottom. A production platform supports a drilling rig which is moved from place to place on the platform so that a number of wells are drilled. It is not uncommon to drill as many as 32 or more wells from a single production platform. From the inception, all the wells are parallel and extend downwardly with parallel portions, at least to a certain depth. Then, they are deviated at some angle. At the outer end of the deviated portion, vertical drilling may again be resumed. While a few of the wells will be more or less vertically drilled, many of the wells will be drilled with three portions, a shallow vertical portion, an angled portion, and a termination portion in the formation which is more or less vertically positioned. Again as before, one or two surveys are required during drilling, and a completion survey is typically required to be able to identify clearly the location of the well in the formation. Field development requires knowledge of the formation itself and also requires knowledge of the termination points of the wells into the formation. This means accurate and precise surveys are used to direct the wells in an optimum fashion to selected locations to get proper production from the formation.

The use of magnetic survey instrumentation is widely applied, but this technology has its limitations. For example, locally, magnetic survey instrumentation accuracy can be limited, since the earth's magnetic field strength and dip angles change, causing erroneous magnetic survey readings. Furthermore, magnetic survey accuracy can also be distorted due to non magnetic drill collars or so called "hot-spots". In addition, the magnetic survey accuracy can also be negatively affected by the presence of adjacent wells, from which the steel casing may severely influence the earth's magnetic field thereby generating erroneous magnetic readings within the well being surveyed. Other issues which affect the magnetic survey accuracy are the platform mass from which the survey is being conducted, geomagnetic interferences, and changes in the earth's magnetic field from one location to another location. Of course, these changes can be accurately measured, but in practice it is not a routine procedure and it further requires well trained field engineers and sophisticated instrumentation. Magnetic survey technology is also not applicable for use in wellbore which have been cased with steel casing.

The mapping apparatus, containing a rate gyroscope and accelerometers, remotely measures the earth's spin axis, and is lowered into the wellbore, while the system is held stationary at predetermined locations. In addition, the apparatus applies a rotary drive mechanism, functionally connected with the gyroscope and the accelerometers to rotate the gyroscope about its instrument or housing axis. Furthermore, the mapping apparatus contains a downhole power supply and data section for processing the sensor outputs to determine the heading direction of the wellbore at predetermined wellbore depths. This invention also discloses a method to measure azimuth very accurately regardless the wellbore deviation angle and latitude, while traversing continuously through a wellbore. A major advantage over U.S. Pat. No. 4,611,405 is the absence of a feed back controlled mechanism, i.e. the absence of a resolver means which is connected with a drive mechanism. In addition, the absence of a costly, power consuming feed back controlled mechanism reduces, significantly, development, operation and maintenance costs.

Survey instruments introduced in the 1980's featured rate gyroscopes and inclinometers in various configurations have been used for a number of years. A representative survey system of that sort is shown in U.S. Pat. No. 4,468,863 and also in U.S. Pat. No. 4,611,405. These instruments do not utilize a measure of the earth's magnetic filed, and can therefore be used in cased boreholes, and further overcome other previously discussed shortcomings of magnetic surveys. In these systems, a gyroscope is mounted with an axis of rotation coincident with the tool body or housing. The housing is an elongate cylindrical structure. Accordingly, the long housing is coincident with the axis of the well. That type system additionally utilizes X and Y axis accelerometers which define a plane which is transverse to the tool body thereby giving instrument inclination and orientation within the borehole. As the well deviates from the vertical, the axis of the gyroscope then is pointed in the correct azimuthal direction. By reading gyroscope movement, the azimuth can be determined and, when combined with the accelerometer measurements, the path of the borehole can be mapped in space.

In present day onshore and offshore drilling operations, highly deviated boreholes being drilled for reasons outlined above. High angles of deviation from the vertical often result in a rather small radius of curvature, or sharp bend in the borehole, thereby limiting the length and diameter of survey equipment that can traverse these bends. The prior art gyro/accelerometer systems discussed above, which are still widely used today, range in diameter up to 10⅝ inches and in length up to 40 feet. These dimensions introduce severe operational problems in traversing sharp or "tight" bends in today's highly deviated wells.

The prior art gyro/accelerometer systems are quite complex and expensive to fabricate and to operate. Still further, these systems must be stopped at discrete survey locations or "stations" within the borehole to obtain "point" readings. The survey instrument is stopped to permit a servo drive control system to restore one of the accelerometers to the horizontal. In effect, the gimbal or other support mechanism for the survey instrument is driven until the accelerometer is positioned in a horizontal plane. There are rather difficult calculations required to recognize the horizontal reference planes sought in that instance. The servo loop must be operated to seek that null position. Once that position is obtained, readings can be taken. This however requires stopping the equipment and permitting an interval of time while the servo loop accomplishes nulling. This requires taking a data point only at specified locations, so that a continuous curve representative of the borehole survey is merely an extrapolation of a number of discrete data points which are taken in space and which are formed into a curve utilizing certain averaging procedures. Furthermore, multiple stationary measurements greatly increases the cost of the survey in increased drilling rig time.

An object of the present invention is to provide a wellbore survey system which will operate in both open boreholes and boreholes cased with steel casing.

Yet another object of the invention is to provide accurate survey data over a wide range of borehole deviation ranging from essentially vertical boreholes to boreholes deviated from the vertical to angles of 90 degrees or more.

A further object of the invention is to provide a borehole survey system which can be conveyed along a wellbore and yield continuous borehole survey data without accuracy degradation in conjunction with quantifiable survey precision.

A still further object of the invention is to provide a survey instrument which is relatively short in length to negotiate short radius curves within the borehole.

Another object of the invention is to provide a smaller diameter survey instrument which can be pumped down the borehole.

Further objects of the invention are to provide a survey instrument which is rugged, reliable, relatively inexpensive to manufacture and operate, and which can be operated at relatively high temperatures.

There are other objects of the invention which will become apparent in the following disclosure.

SUMMARY OF THE INVENTION

The present disclosure provides a markedly improved wellbore survey system. The downhole survey instrument or "probe" utilizes a set of accelerometers which are mounted in the probe's cross borehole plane and mutually perpendicular to one another. In addition, the probe utilizes a dual-axis rate gyroscope, with its spin axis aligned with the axis of the probe. Two measurement principles, the gyrocompassing technique and the continuous survey mode, are employed to calculate wellbore direction as a function of depth. Both principles, and their application to the desired measurement, will be briefly summarized.

The gyrocompassing survey technique is employed to survey near vertical wellbore sections, and to measure the initial heading reference prior to switching to the continuous mode. During the gyrocompassing procedure, the probe is lowered into the wellbore by means of an electric wireline to measure the earth's gravity field and the earth's rate of rotation while the probe is held stationary at predetermined depths. The accelerometers measure the earth's gravity field. This allows computation of the instrument roll angle by determining the ratio of the output of the x-axis accelerometer over the output of the y-axis accelerometer. In addition, mathematical projection of the output of the x-axis accelerometer and the output of the y-axis accelerometer onto the highside direction enables computing the wellbore deviation angle. The azimuth angle is invariant to the earth's gravity field and therefore an additional sensor is used to determine the azimuth angle of the wellbore deviation angle. This is provided by the gyro readings as described in the following paragraph. The rate gyro sensor measures the earth's rate of rotation. Since the earth rotates at a fixed speed and these measurements are made at a given latitude, the vertical and horizontal earth rate vector components can also be derived. These components can then be projected into the sensitive gyro axis plane where the horizontal earth rate component references true north. The rate gyro, therefore, provides an azimuth reading referenced to a fixed point such as true north. By combining the output of the gyro sensitive axes and the accelerometer outputs, the well bore direction, inclination, and tool face can be determined. Depth is incorporated from the amount of wireline deployed to lower the probe within the borehole. Combining a series of survey stations downhole through a calculation method such as minimum curvature yields wellbore trajectory.

The continuous survey mode is based on measuring relative instrument rotations while the probe is continuously traversing through the borehole. After taking a stationary reference heading measurement in the gyrocompassing mode, new modeling procedures allow computation of probe azimuth and inclination changes about the highside and highside right directions, where the highside right direction is at right angles with respect to the highside direction. This is accomplished by mathematically projecting the probe azimuth and inclination changes into the gyro sensitive axis plane.

In order to calculate the actual wellbore path, the rate of rotation about the highside and highside right are integrated over time, yielding wellbore heading and inclination changes from the previously described reference procedure. In conjunction with depth, which is derived by continuously monitoring the amount of wireline deployed, the wellbore trajectory is generated.

An important advantage of the continuous mode is that, unlike gyrocompass surveying, continuous operation has no limitations in angle of inclination above 10 to 15 degrees.

Another obvious advantage of the continuous mode of operation is that the stopping and starting, and the time required to make station measurements, are avoided. Consider as an example that a survey of a well that has a length of 10,000 feet is required. Using the prior art station measurement technique, measurements should be taken at intervals not exceeding 100 feet. Using this criterion, one hundred measurements are required, wherein each measurement requires approximately one minute. Even if the top ten or twenty measurements are skipped because the top portion is fairly well known to be vertical, eighty to ninety station measurements are still needed. If the continuous mode survey of the present invention can eliminate eighty to ninety station measurements, a significant amount of time can be saved. Although time is required to establish a reference heading, and the continuous survey mode does require a finite amount of time, it is estimated that use of the present invention would result in a 25 to 50% reduction in interruption in the drilling process to obtain the survey. If one hour is saved per trip, rig time is reduced by one hour, and on land, that can have a value of easily $500.00 or more per hour. In an offshore drilling vessel, one hour of rig time may cost as much as $5,000–$10,000 per hour. Prices may vary up or down. It is therefore extremely beneficial to be able to run a survey without having to start and stop time and time again.

Another advantage of the present invention is that the quality of the data obtained from the survey is improved by a great amount over station measure surveys, in that measurements made in the continuous mode provide a continuous curve of the measurements. This then enables integration over the time interval of the survey. This permits a continuous survey to be provided. The present survey method and apparatus are probably more accurate than a survey furnished with discrete, stationary data points.

The present invention yields survey data which is not adversely affected by the angle of wellbore inclination. Furthermore, the probe of the present invention is relatively small in diameter, short in length, and can be reliably operated at relatively high temperatures.

In summary, the present disclosure sets out a survey method and apparatus which utilizes a rate gyro having a spin axis coincident with the shell or housing of the downhole instrument probe, which in turn is coincident with the axis of the well borehole. Two accelerometers positioned at right angles are mounted to define a transverse plane at right angles across the instrument. The probe housing is permitted to tumble or rotate in space in the continuous survey mode so that continuous movement including rotation of a random amount and direction is permitted. The output obtained from the system is a continuous data flow, i.e., a continuous well survey can then be obtained.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

DETAILED DESCRIPTION OF THE PREFERRED EMBODIMENT

Before describing in detail the preferred apparatus and methodology of the invention, the several of the basic concepts employed in the invention will be presented as a foundation for more detailed disclosure.

Basic Apparatus and Measured Quantities

Figure 1A:
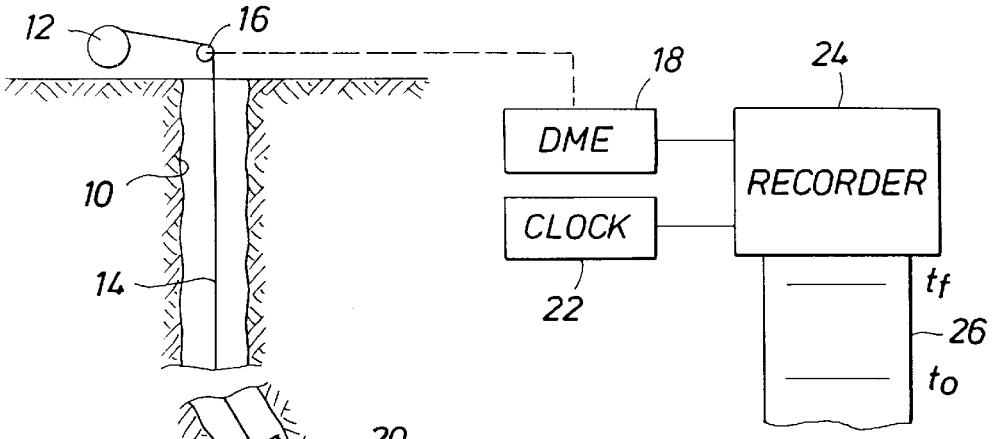
FIG. 1*a* shows a well survey instrument in accordance with the survey probe of the present disclosure positioned in a well borehole, and further shows deviated and essentially vertical portions of the borehole.

Attention is first directed to FIG. 1*a* of the drawings which is a simplified view showing a well during drilling and a well which requires a survey. To provide a context for the method and apparatus of the present disclosure, FIG. 1*a* shows a well borehole 10 which extends into the earth's surface and which has some measure of deviation. The amount of deviation is significant in many instances. To provide a suggested minimum, FIG. 1*a* will be described assuming that the well includes an upper portion which is more or less vertical and a central or lower portion which is inclined at an angle in excess of about 15°. Typically, the well is surveyed at some time during drilling, and especially when drilling a deviated well. Surveys typically are not required when the well is primarily vertical or when the well is relatively shallow. Sometimes, the type of survey made by the present system is not conducted in vertical wells. This type of survey carries a premium charge in comparison with lesser techniques preferred in the survey of vertical wells. Indeed, it may be sufficient merely to drill the well completely without this type of survey equipment should the well be totally vertical and relatively shallow. The present invention is best applied to deeper wells and whose which have deviated portions.

Typically, this well is surveyed before it has been cased from top to bottom. There may be a portion of casing equipment at the top part. Again, the casing may be present only through a few hundred or a few thousand feet of depth. In many instances, the well may be simply open hole. Whatever the circumstances, the present disclosure sets forth the well at a preliminary stage. The well of this disclosure is surveyed by providing a wireline supported instrument probe 20. A drum 12 spools and deploys the wireline cable 14 on the drum thereby conveying the probe 20 along the borehole 10. It is directed into the well through a pulley 16 at the surface, which is often referred to as a "measure" or "sheave" wheel. This pulley also serves as a guide wheel for directing the wireline cable 14 into the wellbore 10, and also serves as an input device for depth measuring equipment (DME) 18 which measures the length of wireline 14 that extends into the wellbore 10. At the bottom of the wireline 14, the survey instrument probe 20 of the present disclosure is supported. The survey instrument 20 comprises an elongate cylindrical shell or housing. The equipment to be discussed below is supported on the interior.

The equipment shown in FIG. 1*a* additionally includes a clock 22 which provides data for a time based recorder 24. That forms a printed record 26 of measured and computed wellbore survey data. The survey record 26 starts at $t_o$ and runs to $t_f$. The time $t_o$ therefore represents the beginning instant of the survey and $t_f$ represents the end of the survey. The record 26 is a recording of survey data as a function of time, or can alternately be converted as a function of the depth of the survey instrument probe 20 along the borehole 10, where depth is measured by the DME 18 by sensing the length of wireline 14 deployed within the borehole 10.

Figure 1B:
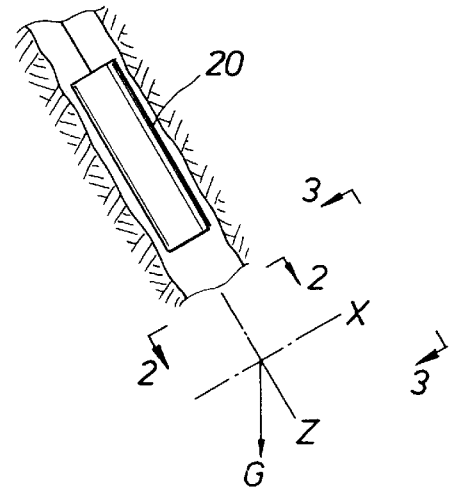
FIG. 1*b* is a view taken along the line 2—2 of FIG. 1*a* looking down the axis of the survey instrument probe housing and showing the X-Y plane at right angles with respect to the axis of the survey instrument.
Figure 1C:
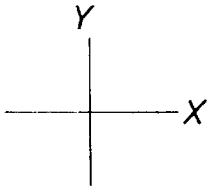
FIG. 1*c* is a view taken along the X axis of FIG. 1*a* showing the tilt of the Y axis.
Figure 1C:
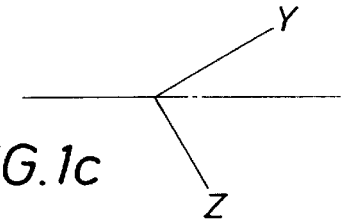

FIG. 1*a* additionally shows a reference system which is tied to the instrument. The Z axis coincides with the elongate axis 21 of the housing 20 and also coincides with the axis of the borehole 10. At the surface, the X and Y axes coincide with a horizontal plane which is transverse to the well borehole 10. As will be understood, this reference system moves with the instrument. When the instrument 20 moves into the deviated portion, that repositions the reference system. In addition, FIG. 1*a* shows the gravity factor which is represented by g. To the left and right of the probe instrument package 20, the X and Y axes define the plane which is horizontal at the surface but which is otherwise tilted depending on the inclination of the survey instrument 20. By viewing the instrument along the X axis as shown in FIG. 1*b*, the Y axis is shown at an inclined angle above the horizontal as illustrated in FIG. 1*c*.

Measurement Principles

As mentioned previously, two measurement principles, the gyrocompassing technique and the continuous survey mode, are employed to calculate wellbore trajectory as a function of depth. These measurement principles, and their application to the desired measurement, will be briefly summarized.

Gyrocompassing Survey Technique

Figure 10:
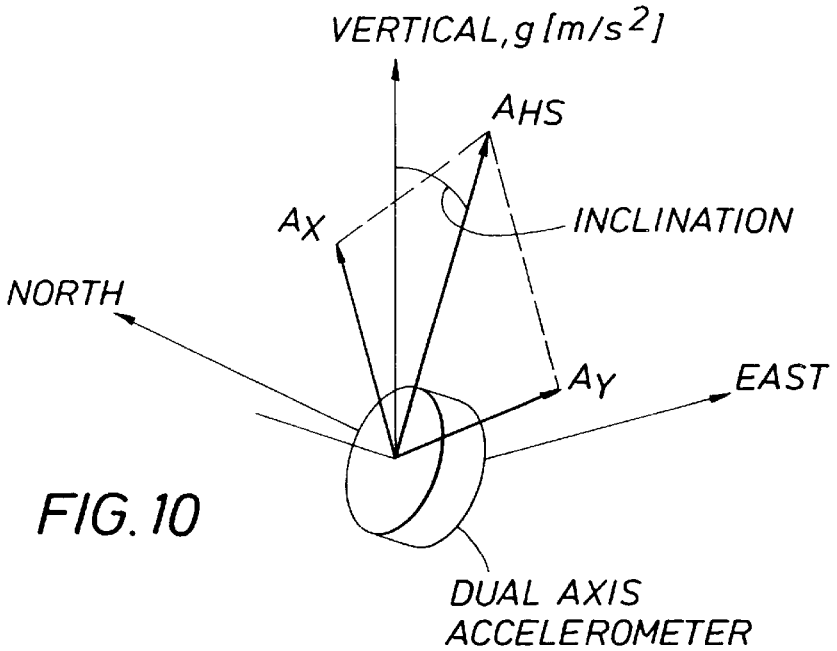
FIG. 10 includes projection of both accelerometer axes onto the highside direction.

The gyrocompassing survey technique is employed to survey near vertical wellbore sections. Furthermore, the gyrocompassing survey technique is used to measure the initial heading reference prior to switching to the continuous mode. During the gyrocompassing procedure, the probe 20 is lowered into the wellbore 10 by means of the electric wireline 14 to measure the earth's gravity field and the earth's rate of rotation while the probe is held stationary at predetermined depths. X and Y accelerometers, denoted as a pair by the numeral 32, measure the gravity field, g, with respect to the axis 21 of the instrument probe 20 as shown in the schematic, three dimensional prospective FIG. 2. The measured quantities are the orthogonal vectors Ax and Ay shown in FIG. 2 The azimuthal orientation of the probe 20 within the borehole 10 defines the "highside tool face", see the accelerometer vectors in the plane at right angles to the housing axis in FIGS. 6, 7 and 10. An accelerometer measures acceleration (in this particular invention the earth's gravity field). The vector combination of the two accelerometers enables measurement of the instrument axis roll or the tool face angle of the instrument. This is performed by determining the ratio of the x-axis accelerometer output over the y-axis accelerometer output. In addition, the accelerometer outputs enable one to determine how far the instrument is deviated from vertical. In other words, the accelerometers define the inclination of the wellbore at a measured depth. In order to do so, the x-axis accelerometer output and the y-axis accelerometer output are projected onto the highside of the crossborehole plane of the instrument. The angle between the projected highside gravity component and the earth's gravity field define the inclination of the wellbore at that particular measured depth. See FIGS. 6, 7 and 10 for visual clarification.

Figure 2:
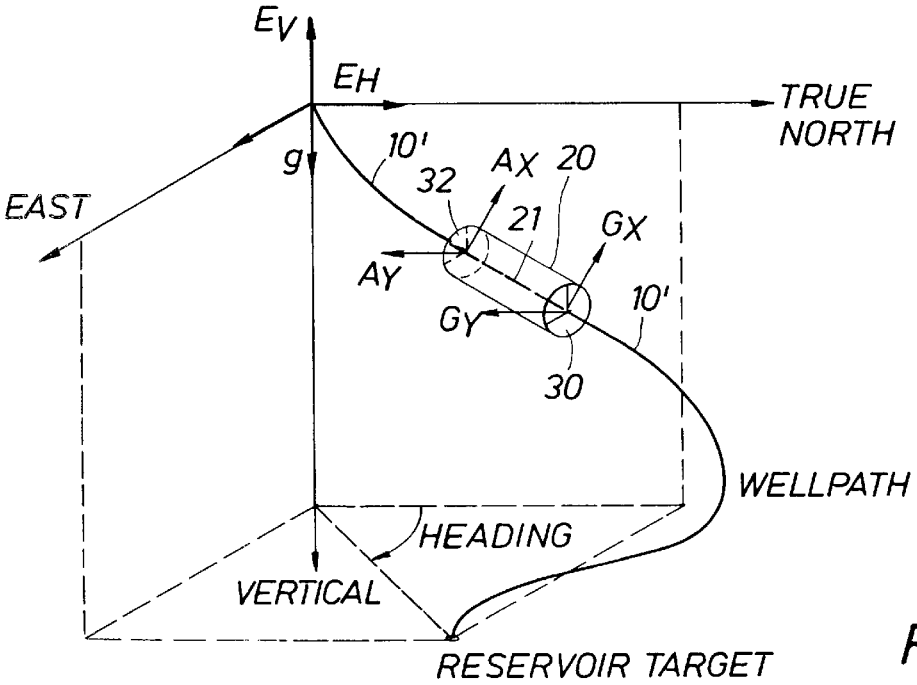
FIG. 2 illustrates gyrocompass surveying with the disclosed survey system, showing the earth's gravity and rotational vectors projected in the sensor axis plane to measure wellbore direction while the survey probe is stationary within the wellbore.

This allows the computation of the inclination of the probe 20, therefore the inclination of the borehole 10 at the position of the probe along the well path 10', to be measured. The computation is performed by means of mathematical projection of the gravity field vector g into the accelerometer sensitive axis plane defined by $A_x$ and $A_y$. It is apparent that the accelerometer readings alone are not sufficient to map the path 10' of the borehole in three-dimensional space, since the heading azimuth of the borehole, shown in FIG. 2, is not known. This is provided by the gyro readings as described in the following paragraph.

Figure 3:
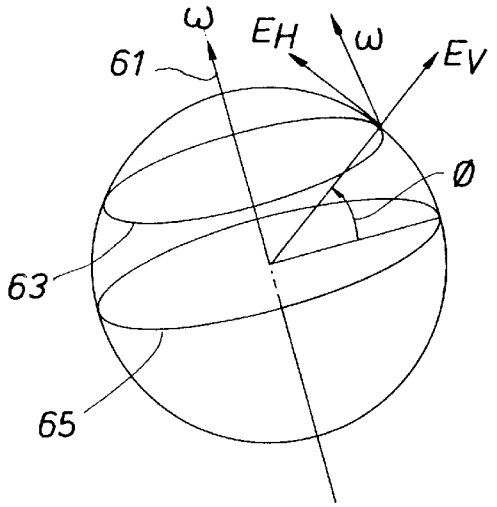
FIG. 3 illustrates the projection of the earth's rotation vector in the horizontal and vertical plane, as a function of latitude.
Figure 4:
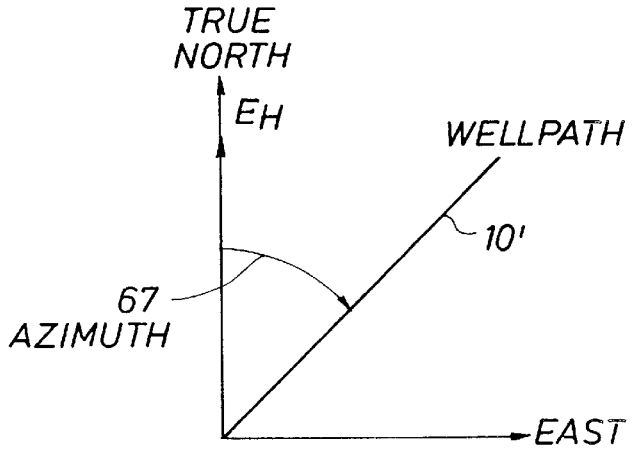
FIG. 4 shows the horizontal earth rate vector referencing true north.

The rate gyro sensor 30 measures the earth's rate of rotation, defined by the vector ω, identified by the numeral 61 in FIG. 3. Since the earth rotates at a fixed speed and these measurements are made at a given latitude 63. The vertical and horizontal components of the earth rate vector components ω, defined as $E_H$ and $E_V$, respectively, can be derived as shown in FIG. 3. Note that the component $E_V$ forms an angle ϕ with the plane 65 defining the earth's equator, therefore defining the latitude of the well borehole. The components $E_H$ and $E_V$ can then be projected into the sensitive gyro axis plane, ($G_y$, $G_x$) where $G_y$ and $G_x$ are the angular rate outputs of the gyro 30, and where the horizontal earth rate component $E_H$ references true north as shown in FIG. 4. The rate gyro, therefore, provides a reading of the azimuth 67 of the well path 10', referenced to a fixed direction such as true north.

By combining the output of the gyro sensitive axes ($G_y$, $G_x$) and the accelerometer outputs $A_x$, $A_y$, the well bore direction, inclination, and tool face highside can be determined. Depth is incorporated from the amount of wireline 10 deployed from the drum 12 to lower the probe 20 within the borehole 10. Combining a series of survey stations downhole through a calculation method such as minimum curvature yields wellbore trajectory path 10'.

Continuous Survey Mode

Figure 5:
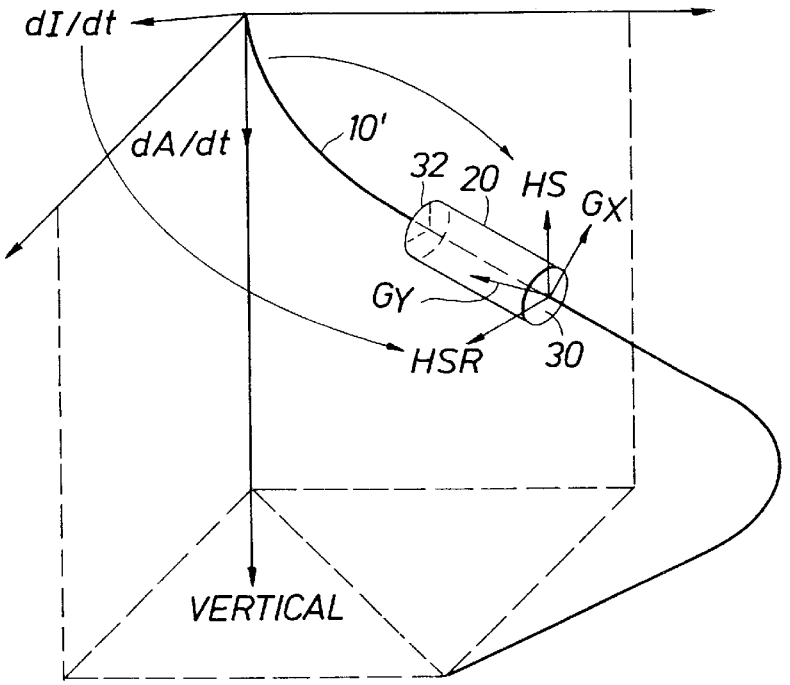
FIG. 5 illustrates the survey system operation when the probe is moving continuously within the borehole, by integrating the highside and highside right measurements over time intervals.

The continuous survey mode is based on measuring relative instrument rotations while the probe 20 is continuously traversing through the borehole 10. After taking a stationary reference heading measurement in the gyrocompassing mode, new modeling procedures allow computation of probe azimuth and inclination changes, dA/dt and dI/dt, respectively, about the highside (HS) and highside right (HSR) directions, where the HSR direction is at right angles with respect to the HS direction. This is accomplished by mathematically projecting dA/dt and dI/dt into the gyro sensitive axis plane (Gy, Gx), as shown in FIG. 5.

In order to calculate the actual wellbore path, the rate of rotation about HS and HSR are integrated over time, yielding wellbore heading and inclination changes from the previously described reference procedure. In conjunction with depth, which is derived by continuously monitoring the amount of wireline 14 deployed, the wellbore trajectory 10' is generated.

Operation, Data Processing, and Results

Recall that the system is operated in the gyrocompassing mode with the survey probe stationary in order to obtain a reference azimuth A and a reference inclination I. In the subsequent continuous mode of operation, the survey probe is conveyed along the borehole, the variation of inclination and azimuth, with respect to the reference inclination and azimuth is measured, and the path or trajectory of the wellbore in three-dimensional space is computed from these measured rates of change. The operation, data processing, and results obtained in both modes of operation will be disclosed in detail.

Gyrocompassing Mode

As shown in FIG. 1*a* of the drawings, the portion of the well which is substantially straight does not require the expensive type survey which is conducted by the present disclosure. Accordingly, the survey instrument 20 need not be run in that portion. It is better to survey that portion of the well with the gyro compass system only. It is also better to run the survey in the highly inclined portion. FIG. 1*a* shows the instrument probe 20 in the radically inclined portion of the well. The survey instrument of the present disclosure is especially effective at inclined angles in excess of about 20° or perhaps even 15° up to above 90°. In a vertical well, the accelerometers (at right angles to gravity) do not provide an output data. Inclination is needed to prompt accelerometer readings. A maximum inclination is not defined. In other words, at that juncture the instrument probe 20 is almost laying in a horizontal wellbore 10. Moreover, the survey instrument and procedure of the present disclosure is best carried out while collecting four data streams from the survey instruments in the survey probe 20. The gyro sensor 30 provides a rate gyro signal. As the Z axis of the gyro is forced from coincidence with the vertical, angular rates are generated. These are rates normally expressed in angular rotation per unit time such as degrees/min. There are two components of the angular rotation rate. The axis of the gyro 30 will be tilted with angular tilt being measured as it is rotated from a true vertical position. Imposing a reference system on the gyro in the perfect upright position, one component of information is the angular rate or $G_x$ and a similar angular deflection is $G_y$. The two measurements are both needed because it would be a rare circumstance in which deflection were totally in only the X or Y dimensions. Therefore the output of the gyro instrument 30 within the survey probe 20 is $G_x$ and $G_y$. As will be understood, the gravity vector is represented by the vector g. The accelerometers 32 form the output signals $A_x$ and $A_y$. There is no need to deploy an accelerometer along the Z axis and hence there is no data $A_z$. If Z axis data is needed, it can be alternately obtained from the wireline movement, and that information as needed is available from the DME data.

Figure 7:
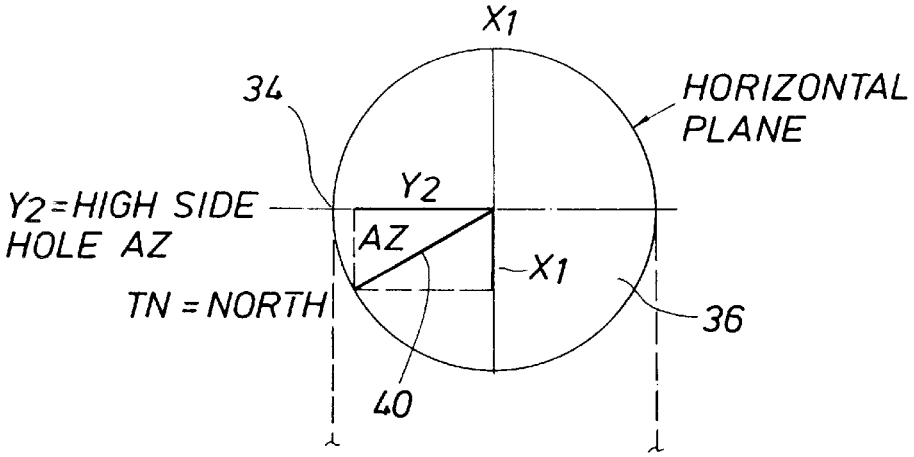
FIGS. 6 and 7 jointly show relative position of the X-Y plane defined by the axis through the survey instrument probe body, and the projection of the X-Y plane into a plane by rotation about an axis.
Figure 6:
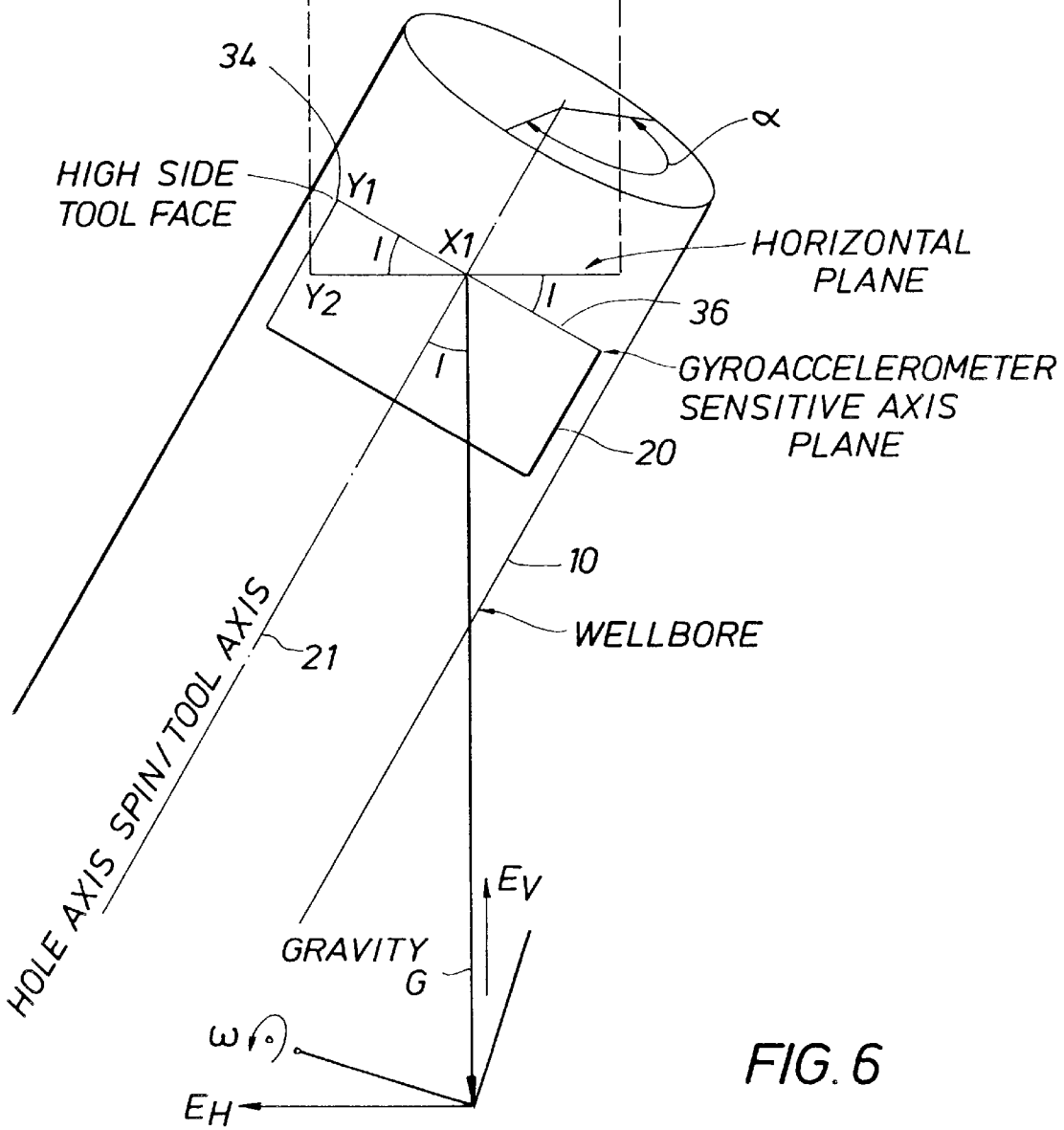

In FIGS. 6 and 7 jointly, the gravity vector g again is shown. FIG. 6 shows in abbreviated fashion the case or housing 20. It has imposed on it the designation at 34 indicating the highside of the tool face. This is the uppermost point on the housing 20 in a transverse plane with respect to the tool axis. The point 34 is located in a plane 36 at right angles to the hole axis and spin axis 21 of the survey probe 20. This plane is defined in the X and Y dimensions. In FIG. 6, it is shown from the side, but at an angle dependent on the angle of deviation of the well. This permits rotation of the plane 36 to the horizontal as shown in the full line representation in FIG. 6, and which is projected into FIG. 7 by the dotted line representation. The highside point 34 is rotated into the horizontal plane shown in FIG. 7. Recall that the gyro 30 has two axes which are maintained in alignment with the X and Y accelerometer axes. Recall also that horizontal earth rate vector $E_H$ can be readily resolved into vector components. This is shown in part in FIG. 7 where the vector 40 is resolved into X and Y components. This is the vector that is indicative of true north and includes the vectoral components resolved in FIG. 7. When that rotation is made, thereby resulting in the projection of the true north vector in the horizontal plane as shown in FIG. 7, the true north vector can then be seen.

The present system forms data which yields the true north measurement which is then converted into the azimuth as shown in FIG. 7. This is the previously discussed reference azimuth A obtained with the system operating in as a station measurement the gyrocompassing mode.

Operation should be considered now. If the probe 20 is suspended in a vertical wellbore, the accelerometer outputs which are $A_x$ and $A_y$ are insensitive to gravity. When the well is deviated as shown in FIG. 1*a* by an amount sufficiently large to define two components, it is possible to represent at least the X and Y components of the gravity vector g so that vector components can be resolved in the X-Y plane. These are represented as $A_x$ and $A_y$ which are added as vector components to obtain two measures of the gravity vector. The vector addition of components $A_x$ and $A_y$ yields the direction of the highside (HS) of the instrument in the borehole 10 at the position of the probe 20.

Mathematical projection of the output of the x-axis accelerometer and the output of the y-axis accelerometer onto the highside direction provides the projected gravity component sensed by the instrument. The angle between the projected gravity component sensed by the instrument and the gravity direction equals the wellbore deviation angle when the instrument is stationary.

The multiple mode of operation is triggered in many ways, for example, by a switch, or by arbitrary depth selection or by computer operation. If several wells are drilled straight below a platform for 1,500 feet and then deviated to reach an underwater field, the first 1,500 feet of hole need not be surveyed. The continuous mode is switched on after 1,500 feet. Restated, no survey is needed for 1,500 feet and the time to is started then. This is implemented by turning on the power supply and data processor at $t_o$ after 1,500 feet. A switch in the data processor is sufficient.

Continuous Mode Operation Once the reference azimuth and reference inclination values, A and I, have been measured with the probe 20 stationary, the continuous mode of operation is initiated. The gyro 30 is locked using a locking apparatus described in the following section. The computation of inclination $I_c$ and azimuth $A_c$ values in the continuous mode, with respect to corresponding reference values I and A measured in the stationary, gyrocompassing mode, is presented in block diagram form in FIG. 8.

The accelerometer outputs $A_x$ and $A_y$, represented by boxes 208 and 212, are used to form the ratio $A_x/A_y$ at the step represented by step 222. The outputs $G_x$ and $G_y$, represented by the boxes 200 and 204, respectively, are combined with this ratio at step 222 to correct the ratio for any non gravity acceleration effects. The computation at step 222 yields the rate of roll over the HSR direction with respect to a reference rate of roll. This quantity is integrated over time, measured from a previously mentioned reference time to, which represents the initiation of the continuous mode operation, and combined with $G_x$ and $G_y$ at step 224 to yield a relative borehole inclination. This relative borehole inclination, when combined with the reference borehole inclination 214 stored in a memory device 220, yields the desired borehole inclination $I_c$ with the system operating in the continuous mode. The $I_c$ output is represented at 230.

Figure 8:
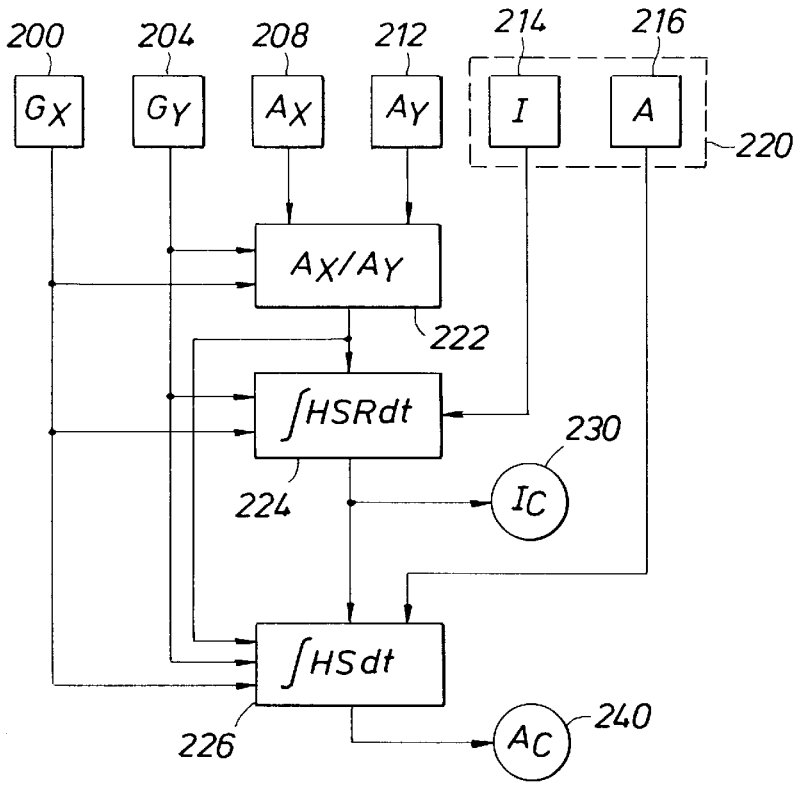
FIG. 8 is a function diagram of the data processing steps used to convert parameters measured by the survey system into well mapping parameters of interest.

Still referring to FIG. 8, the relative borehole inclination, $G_x$ and $G_y$, and $A_x/A_y$, are combined and integrated over time, measured from $t_o$ at step 226. This yields a continuous relative azimuth value measured with respect to A, the reference azimuth 216 stored within the memory 220. The relative azimuth is combined with the reference azimuth A at step 226 to yield the desired azimuth reading $A_c$, represented at 240, which in with the azimuth of the borehole computed with the survey system operating in the continuous mode of operation. As discussed previously, $I_c$ and $A_c$ are combined to yield a map of the borehole in three-dimensional space. All computations are preferably performed at the surface using a central processing unit defined in the following discussion of the system apparatus. To summarize, $A_c$ and $I_c$ are determined mathematically by integrating, over time, measured rates of change of inclination and azimuth with respect to measured, reference azimuth and inclination values. This approach greatly simplifies the downhole equipment required to obtain and accurate and precise map of the wellbore trajectory. The result is a smaller, more rugged survey instrument that those available in the prior art.

APPARATUS DETAILS

Figure 9:
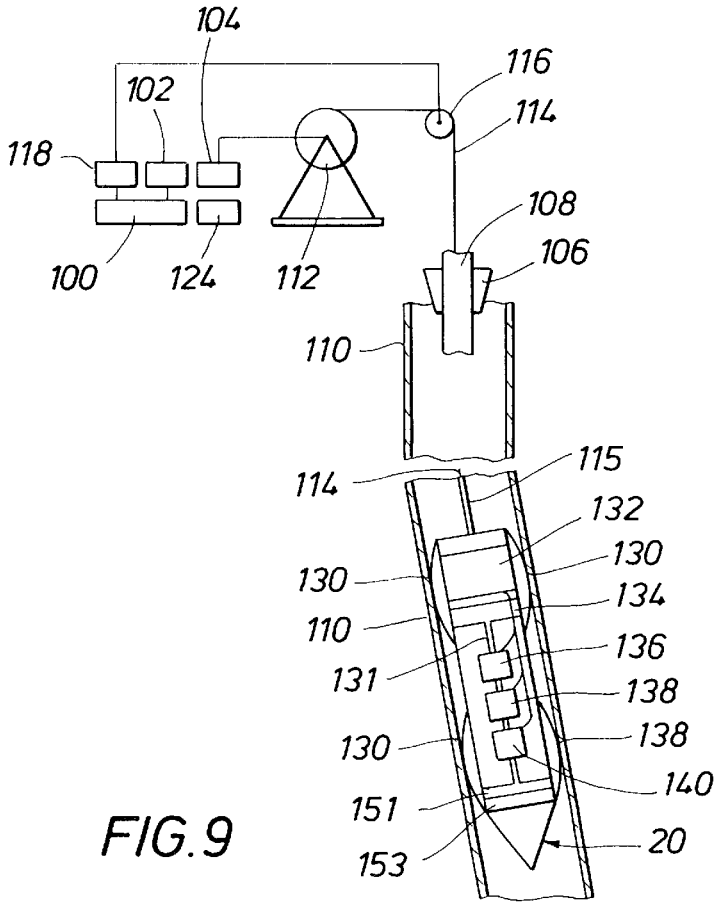
FIG. 9 illustrates the major elements of the downhole and surface components of the survey system.

Attention is directed to FIG. 9 which shows the surface equipment and the downhole instrument probe 20 of the invention. These two basic subsections are connected physically and electronically by means of the wireline cable 114.

The surface equipment will first be discussed. The depth measuring equipment (DME) 118 cooperates with a central processing unit (CPU) 100 and a recorder 124. FIG. 9 also shows a surface interface 102 and a surface power supply 104 which provides power to the elements of the surface equipment. A drum 112 stores wireline cable 114, and deploys and retrieves the cable within the borehole. The cable 114 passes over a measure or sheave well 116 and extends into the wellbore through a set of slips 106 around a pipe 108. The wellbore is shown cased with casing 110.

The instrument probe 20, connected to one end of the wireline 114 by means of a cable head 115, is guided within the casing 110 by a set of centralizing bow springs 130. The probe 20 encloses an electronic assembly and power supply 132 which powers and controls other elements within the probe. A motor 134 rotates a gyro 136 by means of a shaft 131. The motor 134 also rotates the accelerometer assembly, shown separately as an X axis component 138 and a Y axis component 140, by means of the shaft 131. The shaft 131 is terminated at the lower end by a bearing assembly 151 and a lock assembly 153 which fixes the shaft 131 when the drive motor 134 is turned off. Probe instrumentation is relatively compact so the length and diameter of the survey probe 20 are relatively small. Furthermore, the instrumentation within the probe 20 is relatively simple thereby yielding a very reliable well survey system. Other stated objects of the present invention are achieved as discussed in other sections of the above disclosure.

Figure 11:
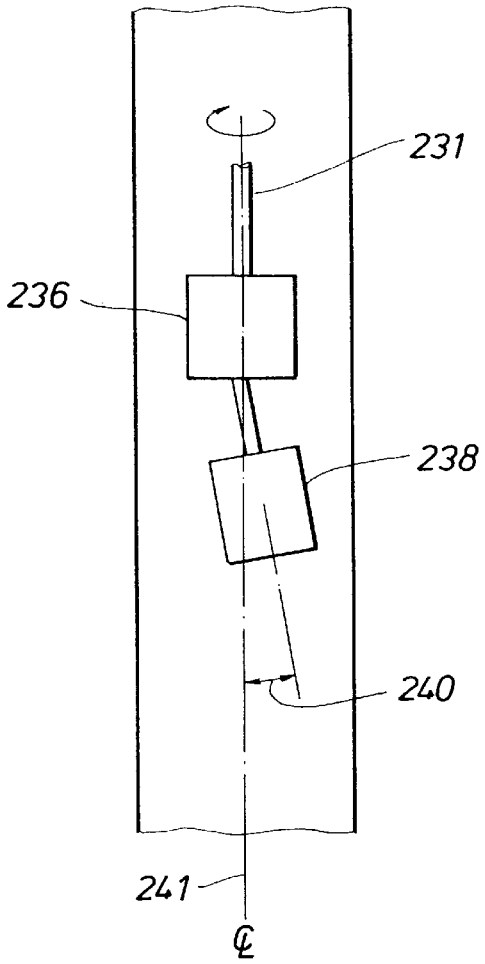
FIG. 11 shows a bent axis arrangement for the accelerometer plane.

Attention is directed to FIG. 11 which shows a modified form of instrument. The illustrated portion includes a shaft 231 aligned on the housing centerline and which corresponds to the shaft 131 described with respect to FIG. 9. The shaft rotates the gyro 236 in the same fashion but the next shaft portion is set at an angle. The angled shaft 239 rotates an accelerometer assembly 238 having the same accelerometers in it as embodiments mentioned earlier. The angle 240 is typically 10° to 30°, the preferred value being about 15°. The canted angle 240 provides an added data. The unprocessed output of the X and Y accelerometers provides two data streams which both can be resolved in two components, one being along the housing or tool axis or centerline 241 (see FIG. 11) and the second resolved component at right angles to the centerline 241. This angled mounting of the sensors 238 enhances performance by providing more data in vertical well portions.

While the foregoing is directed to the preferred embodiment, the scope can be determined from the claims which follow.

What is claimed is:

1. A method of conducting an oil well survey along a well borehole comprising the steps of:

(a) moving an elongate sensor housing having an axis coincident therewith along a well borehole between first and second selected positions to form a survey between said first and second positions, wherein said first position is located within a non vertical section of said well borehole;

(b) positioning a rate gyro in said housing wherein said rate gyro forms rate gyro output signals indicative of measured angular rate between said first and second positions and taking a set of measurements to initialize the gyro at the first position;

(c) positioning in said housing first and second accelerometers at a right angle therebetween wherein said accelerometers define a transverse plane to the axis of said housing; and forming accelerometer output signals from said first and second accelerometers indicative of values sensed thereby at said first position and during movement between first and second positions in said well borehole;

(d) forming stored gyro data representative of said rate gyro output signals, relative to a reference azimuth measured by said rate gyro with said sensor housing stationary at said first position, during movement between said first and second positions along the well borehole;

(e) forming stored accelerometer data representative of said accelerometer output signals, relative to a reference inclination measured by said accelerometers with said housing stationary at said first position, during movement between said first and second positions alone the well borehole; and (f) converting said stored rate gyro data and said stored accelerometer data into a plot of well borehole azimuth between said first and second positions.

2. The method of claim 1 wherein said housing is an elongate cylindrical housing and including the step of moving said housing along the well borehole suspended from a cable and moving said housing in a continuous motion between said first and second positions.

3. The method of claim 1 wherein said rate gyro is initially oriented to define an axis thereof coincident with the axis of said housing, and forming resolved X and Y components of movement of said rate gyro in said housing while moving between said first and second positions.

4. The method of claim 1 wherein said housing is suspended on an elongate wireline in said well borehole and said wireline is moved upwardly or downwardly to move said housing in said well borehole and movement of said housing is measured as a function of time to depth.

5. The method of claim 1 wherein said rate gyro is provided with first and second rate sensors at right angles for forming said rate gyro signals in X and Y axes with respect to the Z axis of the rate gyro, and further including the step of positioning the rate gyro so that the Z axis thereof coincides with said housing, and subsequently calculating azimuth from said rate gyro.

6. The method of claim 1 wherein said first and second positions are in a well borehole inclined by a specified angle from the vertical.

7. A method of conducting an oil well survey along a well borehole comprising the steps of:

(a) moving an elongate sensor housing having an axis coincident therewith along a well borehole between first and second selected positions to form a survey between said first and second positions, wherein said first position is located within a non vertical section of said well borehole;

(b) positioning a rate gyro in said housing wherein said rate gyro forms output signals to initialize the gyro and also indicative of measured angular rate at said first position and between said first and second positions;

(c) positioning in said housing first and second accelerometers at a right angle therebetween wherein said accelerometers define a transverse plane to the axis of said housing, and forming outputs from said first and second accelerometers indicative of values sensed thereby at said first position and during movement between first and second positions in said well borehole and relative to a reference inclination at said first position;

(d) converting, data representative of the outputs of said rate gyro and said accelerometers during movement between said first and second positions along the well borehole to determine well borehole inclination; and (e) recording a plot of well borehole inclination to form a plot between said first and second positions.

8. The method of claim 7 wherein said housing is suspended on an elongate wireline in said well borehole and said wireline is moved upwardly or downwardly to move said housing in said well borehole and movement of said housing is measured as a function of time and depth to form a record thereof.

9. The method of claim 7 wherein said first and second positions are in a well borehole inclined by a specified angle from the vertical.

10. The method of claim 7 wherein said housing is an elongate cylindrical housing and including the step of moving said housing along the well borehole suspended from a cable and moving said housing in a continuous motion between said first and second positions to obtain azimuth and depth between said fist and second positions.

11. The method of claim 10 wherein said rate gyro is initially oriented to define an axis thereof coincident with the axis of said housing, and forming resolved X and Y components of movement of said rate gyro in said housing while moving between said first and second positions.

12. The method of claim 7 wherein said rate gyro is provided with first and second rate sensors at right angles for forming gyro rate output signals in X and Y axes with respect to the Z axis of the rate gyro, and further including the step of restoring the rate gyro so that the Z axis thereof coincides with said housing, and subsequently calculating well borehole azimuth with respect to a reference azimuth measured with said rate gyro and with said sensor housing stationary at said first position.

13. The method of claim 12 wherein said first and second positions are in a well borehole inclined by a specified angle from the vertical.

14. A method of conducting an oil well survey along a well borehole comprising the steps of:

(a) moving an elongate sensor housing having an axis coincident therewith along a well borehole between first and second selected positions to form a survey between said first and second positions, wherein inclination of said well borehole at said first position is greater than about 15 degrees;

(b) positioning a rate gyro in said housing wherein said rate gyro forms output signals to initialize the gyro and also indicative of measured angular rate;

(c) positioning in said housing first and second accelerometers at a right angle therebetween wherein said accelerometers define a transverse plane to the axis of said housing; and forming outputs from said first and second accelerometers indicative of values sensed thereby during movement between first and second positions in said well borehole with respect to a reference inclination at said first position;

(d) forming stored data representative of the outputs of said rate gyro with respect to a reference azimuth at said first position and said accelerometers during movement between said first and second positions along the well borehole to determine well borehole azimuth and inclination; and (e) recording a plot of well borehole azimuth and inclination between said first and second positions.

15. The method of claim 14 wherein said housing is an elongate cylindrical housing and including the step of moving said housing along the well borehole suspended from a cable and moving said housing in a continuous motion between said first and second positions.

16. The method of claim 14 wherein said rate gyro is provided with first and second rate sensors at right angles for forming gyro rate output signals in X and Y axes with respect to the Z axis of the rate gyro, and further including the step of positioning the rate gyro so that the Z axis thereof coincides with said housing to direct said housing axis along said borehole, and determining azimuth from said rate gyro.

17. The method of claim 14 wherein said first and second positions are in a well borehole inclined by a specified angle from the vertical.

18. The method of claim 14 wherein said rate gyro is initially oriented to define an axis thereof coincident with the axis of said housing, and forming resolved X and Y components of movement of said rate gyro in said housing while moving between said first and second positions.

19. The method of claim 18 wherein said housing is suspended on an elongate wireline in said well borehole and said wireline is moved upwardly or downwardly to move said housing in said well borehole and movement of said housing is measured as a function of time to form a record thereof.

20. A method of conducting an oil well survey along a well borehole comprising the steps of:

(a) moving an elongate sensor housing along a well borehole between first and second selected positions to form a survey between said first and second positions, wherein inclination of said well borehole at said first position is greater than about 15 degrees;

(b) positioning a rate gyro in said housing wherein said rate gyro forms orthogonal output signals to initialize the gyro and also indicative of measured angular rate;

(c) positioning in said housing first and second accelerometers at a right angle therebetween wherein said accelerometers define a transverse plane to the axis of said housing;

(d) measuring a reference azimuth and a reference inclination at said first position and computing and storing data representative of the outputs of said rate gyro relative to said reference azimuth and said accelerometers relative to said reference inclination during continuous, unstopped movement between said first and second positions along the well borehole; and (e) converting the stored data into a plot of well borehole azimuth between said first and second positions.

21. The method of claim 20 wherein said housing is an elongate cylindrical housing and including the step of moving said housing along the well borehole in a continuous motion between said first and second positions.

22. The method of claim 21 including the step of measuring housing rotation during movement, and projecting the measured housing rotation to a reference plane to fix in relative space one of said accelerometer outputs.

23. The method of claim 22 including the step of creating a Z axis output from accelerometer data.

24. The method of claim 22 including the step of setting the reference plane to obtain a reference horizontal plane relative to gravity.

25. The method of claim 22 including the step of projecting the gyro output data into a horizontal plane for measuring inclination from the gyro data.

26. An apparatus comprising:

(a) an elongate housing having an axis along the length thereof;

(b) a motor in said housing for rotating a shaft extending along said housing;

(c) a rate gyro supported by said housing and axially aligned within said housing and connected to said shaft for rotation thereby;

(d) a pair of accelerometers defining an X and Y plane wherein said pair are at right angles, and are rotated by said motor shaft;

(e) a signal processor connected to said rate gyro and said pair of accelerometers to process signals therefrom from a survey of a well borehole, wherein said signal processor (i) forms a ratio of X and Y components of outputs of said accelerometers projected onto said X and Y planes, and (ii) combines X and Y outputs from said rate gyro with a function of said ratio thereby correcting said ratio for any non gravity acceleration effects and yielding a relative borehole inclination; and (f) a control for said signal processor to initialize operation so that said processor forms a survey between first and second locations in said well borehole, wherein inclination of said well borehole at said first location is greater than about 15 degrees.

27. The apparatus of claim 26 wherein said control and said signal processor form a survey of the well borehole beginning from a specified angle with respect to the vertical and relating said relative borehole inclination thereto.

28. The apparatus of claim 26 wherein said control responds to an angular change with respect to vertical in excess of a selected angle.

29. The apparatus of claim 26 wherein said gyro is rotated about said housing axis and said pair of accelerometers defines a plane at a non normal angle with respect to said axis.

30. The apparatus of claim 29 wherein said motor shaft is coincident with said housing axis at said rate gyro to mount said gyro for axial rotation, and said shaft is angled to said pair to define a non normal plane for said pair with respect to said housing axis.

31. A method of conducting an oil well survey along a well borehole comprising the steps of:

(a) moving an elongate sensor housing along a well borehole between first and second selected positions to form a survey between said first and second positions, wherein said first position is located within a non vertical section of said well borehole;

(b) positioning a rate gyro in said housing wherein said rate gyro forms orthogonal output signals to initialize the gyro and also indicative of measured angular rate;

(c) positioning in said housing first and second accelerometers at a right angle therebetwecn wherein said accelerometers define a transverse plane to the axis of said housing;

(d) measuring gravity induced signals from said first and second accelerometers at the first position and determining therefrom a vector component describing the first position wherein the component includes well borehole inclination;

(e) measuring at the first position a vector component describing housing azimuth;

(f) moving the housing along the well borehole from the first to a second position in the well borehole;

(g) storing data representing the inclination and azimuth between first and second positions;

(h) measuring a reference azimuth and a reference inclination at said first position and computing and storing data representative of the output of said rate gyro relative to azimuth;

(i) storing data representative of said accelerometers relative to inclination; and (j) converting the stored data into a plot of well borehole azimuth between said first and second positions.

32. The method of claim 31 including the step of measuring linear travel of said housing along the well borehole between the first and second positions.

33. The method of claim 31 including the step of measuring housing rotation as indicated by signals from said accelerometers.

34. The method of claim 31 including the step of measuring data from said rate gyro indicative of relative rotation of said housing in space from said first position.

35. A method of conducting an oil well survey along a well borehole comprising the steps of:

(a) moving an elongate sensor housing along a well borehole between first and second selected positions along the well borehole to form a borehole survey between said first and second positions, wherein said first position is located within a non vertical section of said well borehole;

(b) measuring angular rate of the housing on movement between said first and second positions;

(c) placing first and second accelerometers at a right angle in said housing wherein said accelerometers define a transverse plane to axis of said housing;

(d) measuring gravity induced signals from said first and second accelerometers at the first and second positions;

(e) determining the well borehole inclination;

(f) determining a vector component describing housing azimuth;

(g) moving the housing along the well borehole from the first to a second position in the well borehole;

(h) storing data representing the inclination and azimuth between first and second positions; and (i) converting the stored data into a plot of well borehole azimuth between said first and second positions after initializing the stored data to form a reference at said first position.

36. The method of claim 35 including the step of measuring linear travel of said housing along the well borehole between the first and second positions.

37. The method of claim 36 including the step of measuring housing rotation as indicated by signals from said accelerometers.

38. The method of claim 37 including the step of measuring data from said rate gyro indicative of relative rotation of said housing in space from said first position.

39. A method of conducting an oil well survey comprising the steps of:

(a) positioning a sensor housing in a well borehole to conduct a survey;

(b) positioning a gyro in said housing wherein said gyro forms orthogonal output signals responsive to gyro operation with housing movement along said well borehole movement;

(c) positioning two orthogonal accelerometers in a plane transverse to said housing to form accelerometer output signals;

(d) defining from said orthogonal accelerometer signals tool high side at a first time, wherein said sensor housing is located within a non vertical section of said well borehole at said first time;

(e) determining at an initialized first time the position of the gyro as indicated by the output signals of the gyro;

(f) moving the housing along the well borehole from the first time to a second time; and determining between said first and second times rotation of the housing around an axis along the well borehole in response to said output signals.

* * * * *